US006196865B1

(12) United States Patent
Ruffel et al.

(10) Patent No.: US 6,196,865 B1
(45) Date of Patent: Mar. 6, 2001

(54) REMOVABLE REAR CONNECTOR FOR A CIRCULAR ELECTRICAL PLUG

(75) Inventors: Régis Ruffel, Carcassonne; Gilles Tournier, Leguevin; Marie-Thérèse Dardenne, Colomiers, all of (FR)

(73) Assignee: Aerospatiale Societe Nationale Industrielle, Paris (FR)

( * ) Notice: Subject to any disclaimer, the term of this patent is extended or adjusted under 35 U.S.C. 154(b) by 0 days.

(21) Appl. No.: 09/297,526

(22) PCT Filed: Oct. 21, 1998

(86) PCT No.: PCT/FR98/02250

§ 371 Date: May 3, 1999

§ 102(e) Date: May 3, 1999

(87) PCT Pub. No.: WO99/21249

PCT Pub. Date: Apr. 29, 1999

(30) Foreign Application Priority Data

Oct. 22, 1997 (FR) ..... 97 13231

(51) Int. Cl.[7] ..... H01R 13/58
(52) U.S. Cl. ..... 439/472; 439/470
(58) Field of Search ..... 439/470, 445, 439/321, 472, 473, 469

(56) References Cited

U.S. PATENT DOCUMENTS

| | | | | |
|---|---|---|---|---|
| 3,904,265 | * | 9/1975 | Hollyday et al. | 439/469 |
| 4,280,746 | * | 7/1981 | Ignatowicz | 439/470 |
| 4,721,830 | * | 1/1988 | Dagan et al. | 174/41 |
| 4,808,123 | * | 2/1989 | Dee et al. | 439/470 |
| 4,984,995 | * | 1/1991 | Tucker et al. | 439/321 |
| 5,018,987 | * | 5/1991 | Kirma | 439/445 |
| 5,178,559 | * | 1/1993 | Mello | 439/472 |

* cited by examiner

*Primary Examiner*—Brian Sircus
*Assistant Examiner*—Chandrika Prasad
(74) *Attorney, Agent, or Firm*—Burns, Doane, Swecker & Mathis, LLP

(57) ABSTRACT

A connector composed of two hinged subassemblies (26, 28) that enable a removable rear connector to be fitted onto a plug (10) whether or not fitted with its wiring. Subassembly (26) comprises a collar formed of at least two sections (36*a*, 36*b*) capable of being placed behind the plug (10). Subassembly (28) forms a ring formed of at least two sections (56*a*, 56*b*) designed simultaneously to encircle the rear of the plug (10) and the collar. The ring operates in conjunction with the connector by means of threads (20, 60) and with the collar by means of a assembly consisting of a throat (62) and a ring-shaped ridge (54). The subassembly (26) is also prevented from rotating relative to plug (10).

10 Claims, 2 Drawing Sheets

REMOVABLE REAR CONNECTOR FOR A CIRCULAR ELECTRICAL PLUG

FIELD OF THE INVENTION

The present invention relates to a rear connector designed to be fitted to the wiring side of a plug in order to fit said plug with an accessory that serves, for example, to retain the cables and/or ensure leaktightness.

Throughout the present text the terms "rear" and "forward" assume that the rear of the plug is the side to which the cables are connected.

The removable rear connector of the invention may be used on any plug provided with a threaded rear section. Cylindrical multi-conductor plugs, normally known as "circular plugs", come into this category. The plug of the invention may, however, be used on other types of plug such as fiber optic connectors, hybrid connectors, etc.

BACKGROUND ART

Most electrical plugs of the prior art are provided with a threaded rear section that enables a removable rear connector to be fitted to them. This connector, which constitutes an accessory for the plug, is often referred to as a cable clamp since its main function is usually to retain cables in a desired position in the immediate proximity of the connector.

Rear connectors of the prior art comprise a ring that constitutes a nut designed to be screwed onto the threaded rear section of the plug. By means of one or more arms, this ring includes a system for retaining the cables composed, for example, of two half-flanges capable of pressing against one another by means of a screw. The arms connecting the ring to the cable retaining system are shaped to hold the cables at the required angle. The cables may therefore be held in the axis of the plug or at an angle relative to this axis, for example 45° or 90°.

Irrespective of their shape, all the rear connectors of the prior art comprise a ring constructed as a single part. Consequently, these types of connector must be threaded onto the cables before the ends of the cables are connected to the plug. Failure to do this means that the operator must disconnect all the cables from the plug and then reconnect them including the connector. In addition to the time wasted carrying out these operations, the chances of connecting cables wrongly are greatly increased.

Similarly, any maintenance operation to replace the connector or part thereof also involves disconnecting and reconnecting all the cables once replacement is complete. The drawbacks of this type of operation are the same as when an operator has forgotten install the rear connector before connecting the cables to the plug.

DISCLOSURE OF THE INVENTION

The subject-matter of the invention is thus a removable rear connector whose original design enables it to fitted to a plug to which the cables have already been connected, or removed from the plug without the need to disconnect the cables.

According to the invention this is achieved by using a removable rear connector for a plug that includes a threaded rear section characterized in that it comprises:

- a first hinged subassembly comprising at least two arc-shaped collar sections capable of forming a collar and having a stepped outer surface;
- a second, ring-shaped, hinged subassembly formed by at least two arc-shaped ring sections including a forward threaded section and a rear stepped section that fit the rear threaded section of the connector and the stepped outer surface of the collar respectively.

This type of rear connected may easily be fitted onto or removed from a plug irrespective of whether the cables have already been connected, thereby overcoming all the problems of connectors of the prior art. The connector is fitted by positioning the first hinged assembly so that the two arc-shaped sections of the collar close over the bundle of cables immediately behind the rear threaded section of the connector. The rear threaded section and the collar formed by the first hinged section are thus simultaneously encircled by closing the second hinged subassembly around them.

In a preferred embodiment of the invention the collar formed by the first hinged subassembly has a forward surface provided with anti-rotation means capable of operating in conjunction with complementary means formed on a rear surface of the connector. These anti-rotation means may consist of a toothed wheel formed on the forward surface of the collar.

In this embodiment of the invention the rear stepped section of the inner surface of the second hinged subassembly has a ring-shaped throat that operates in conjunction with a ring-shaped ridge formed on the outer surface of the collar.

The second hinged subassembly is preferably composed of two hinged semicircular ring sections capable of being connected at their opposite ends by a removable component such as a screw fitted parallel to the axes of the said sections of the ring. This arrangement facilitates fitting and removal, particular where several plugs are used side by side on the same panel.

Moreover, the first hinged subassembly advantageously comprises two semicircular collar sections that are fastened firmly to the first ends of two arms and a half-flange on which the opposite end of at least one of the two arms is hinged. Depending on the configuration chosen, the two arms may be hinged on the half-flange, or only one of the arms may be hinged on the half-flange, the other being fastened firmly to it.

Cable clamping means such as a second half-flange are then fitted onto the half-flange of the first hinged subassembly using removable fastening means.

To prevent any relative movement between the sections of the arc-shaped collar of the first hinged assembly, the ends of these sections of the collar preferably have complementary shapes so that they can fit one into the other.

BRIEF DESCRIPTION OF THE DRAWINGS

A preferred but non-limitative example of the invention will now be described with reference to the attached drawings wherein.

DETAILED DESCRIPTION OF A PREFERRED EMBODIMENT

Figure 1:
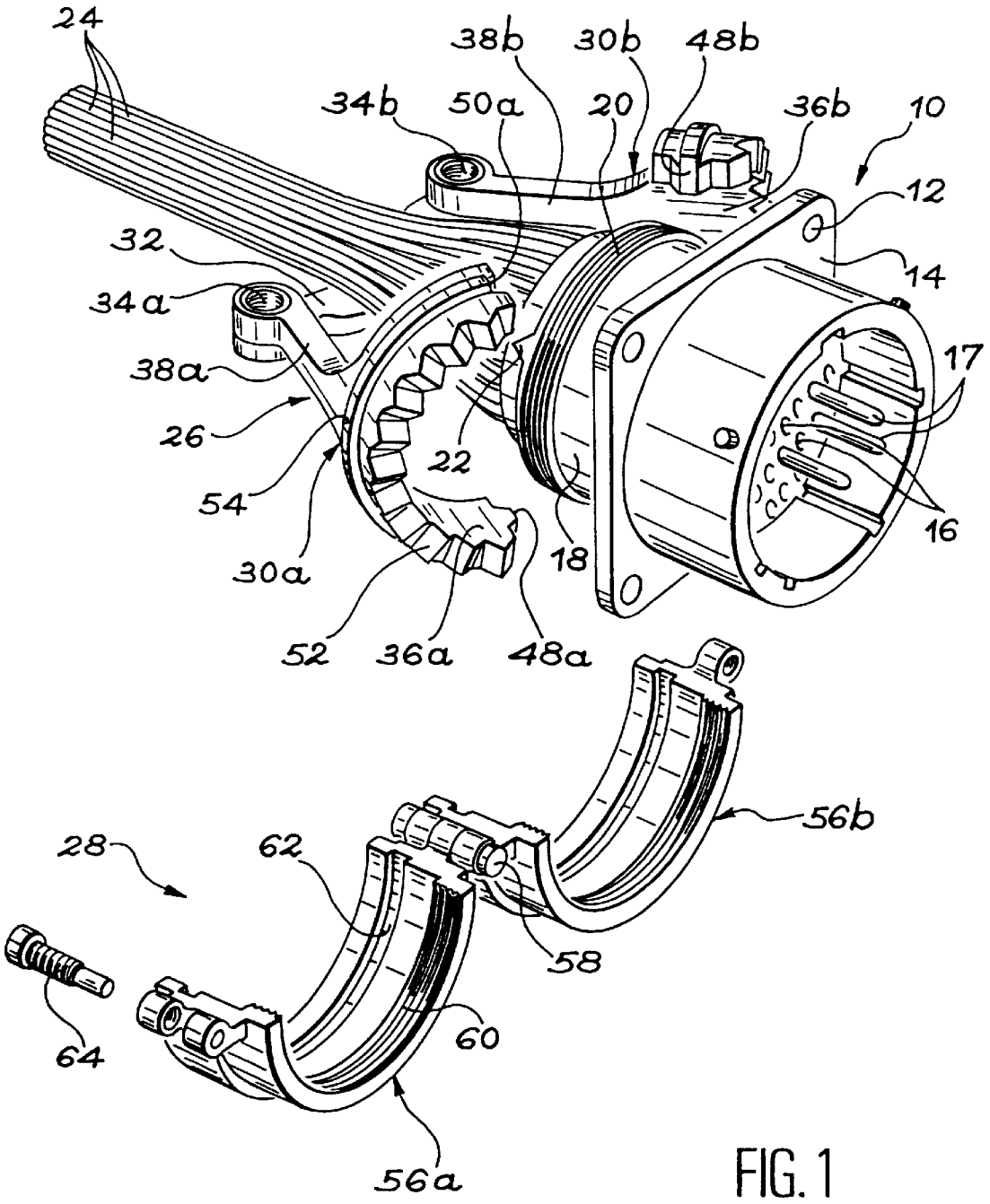
FIG. 1 is a perspective view showing the two hinged subassemblies in the open position, hinged around the removable rear connector of the invention, together with a wired plug that may be fitted with the connector.
Figure 2:
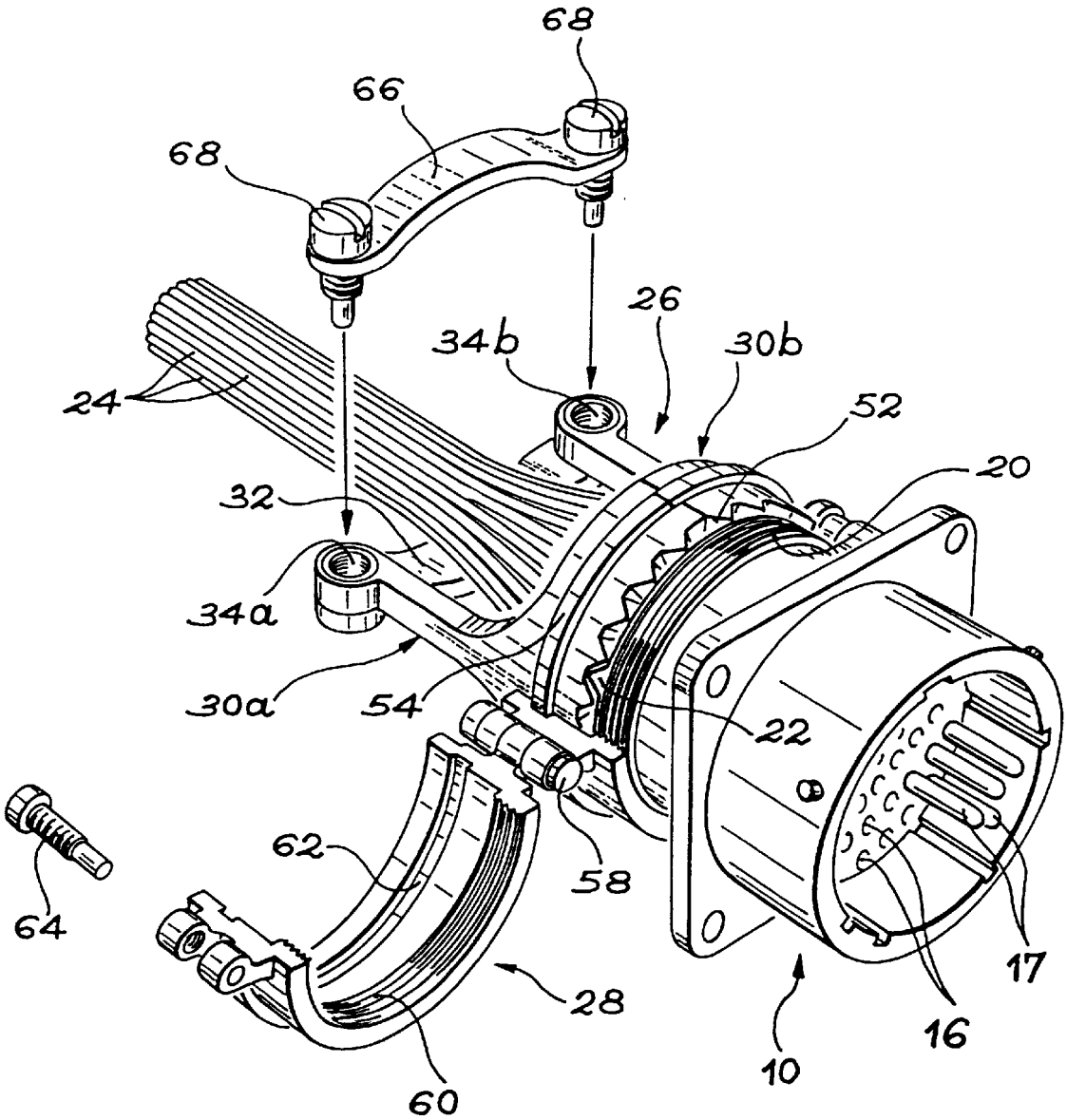
FIG. 2 is a perspective view similar to FIG. 1 showing the final stages of fitting the connector to the plug.

In FIGS. 1 and 2 the number 10 is used to refer to generally a plug on which a removable rear connector of the invention can be fitted. As has already been pointed out, the removable rear connector of the invention may be used on various types of plug such that the plug 10 shown in the figures only constitutes an example that should not be considered limitative of the possible uses of the connector of the invention.

In the version shown, connector 10 is a circular multi-cable plug designed to be mounted on a panel by screws (not shown) that pass through holes 12 in plate 14. In this example plug 10 is a fixed connector comprising cylindrical cavities whose openings are located on the forward surface of the plug and designed to receive male contacts 17.

Using principles known in the art, a removable plug comprising female contacts may also be directly coupled to it.

Behind plate 14 the plug 10 constitutes a cylindrical barrel 18 machined with a rear threaded section 20. Behind this rear threaded section 20 cylindrical barrel 18 presents a rear surface in which there is at least one triangular-shaped tooth 22. In a strictly non-limitative example, three teeth 22 may be provided on the rear surface of cylindrical barrel 18, said teeth being regularly placed around the axis of plug 10.

A bundle of cables 24 is connected to plug 10. More precisely, each of cables 24 is electrically connected to a male contact 17 that is then inserted into one of the cylindrical cavities 16 of plug 10 that extend from the rear to the front of the plug and whose openings are located on the forward surface.

FIGS. 1 and 2 also show the main components of a removable rear connector of the invention capable of being fitted to plug 10 or removed therefrom without any of the cables 24 being disconnected from plug 10.

The removable rear connector of the invention comprises a first hinged subassembly numbered 26 in the figures and a second, ring-shaped hinged subassembly numbered 28. A detailed description of each of these two subassemblies will now be given.

First hinged subassembly 26 is composed of three parts 30*a,* 30*b* and 32 and each of parts 30*a* and 30*b* is mounted on part 32 by means of pins 34*a,* 34*b.*

More precisely, each of parts 30*a* and 30*b* comprises a semicircular collar 36*a,* 36*b* and an arm 38*a,* 38*b,* a first end of which is rigidly fastened to its corresponding semicircular collar section. As can be seen from the figures, arms 38*a* and 38*b* and semicircular collar sections 36*a* and 36*b* may be constructed in a single piece. In the version shown, arms 38*a* and 38*b* are more or less straight, connected to the middle of semicircular collar sections 36*a* and 36*b* and lying parallel to the axis of the corresponding section of the collar.

The third component 32 of the first hinged subassembly 26 is a half-flange on the ends of which parts 30*a* and 30*b* hinge. More precisely, parts 30*a* and 30*b* are hinged on half-flange 32 by the ends of arms 38*a* and 38*b* opposite to those bearing semicircular collar sections 36*a* and 36*b.* Pins 34*a* and 34*b* are fitted parallel to one another at right angles to the axes of semicircular collar sections 36*a* and 36*b.*

The arrangement described above allows the first hinged subassembly 26 to be either in an open position, as seen in FIG. 1, in which parts 30*a* and 30*b* are moved on pins 34*a* and 34*b* so that they are distant from one another, or in a closed position, as seen in FIG. 2, in which parts 30*a* and 30*b* are pressed together by the ends of semicircular collar sections 36*a* and 36*b.*

When first hinged subassembly 26 is in the open position, it may be put into position or separated from plug 10 and its bundle of cables 24 as shown in FIG. 1. In contrast, when first hinged subassembly 26 is in the closed position, the semicircular collar sections 36*a* and 36*b* form a collar that completely encircles bundle of cables 24 behind the rear surface of cylindrical barrel 18 of plug 10.

In order to prevent any relative movement between the ends of the two semicircular collar sections 36*a* and 36*b* when first hinged subassembly 26 is in the closed position, the facing tips of these collar sections are constructed with matching shapes to fit into one another. The respective ends of section 36*a* are fitted with a projection 48*a* and a recess 50*a* while the corresponding ends of section 36*b* are fitted with a recess (not visible in the figures) and a projection 48*b.*

When first hinged subassembly 26 is in the closed position shown in FIG. 2, the forward surface of the collar formed by the two semicircular collar sections 36*a* and 36*b* presents anti-rotation means composed of a toothed wheel 52. More precisely, this toothed wheel 52 is formed of triangular teeth that fit teeth 22 that project from the rear surface of cylindrical barrel 18 of plug 10. These triangular teeth are machined on the forward surface of each of semicircular collar sections 36*a* and 36*b.*

The anti-rotation means formed by toothed wheel 52 thus operate in conjunction with the complementary means formed by teeth 22 to prevent first hinged subassembly 26 rotating relative to plug 10 when said first subassembly is in the closed position and held against the rear surface of cylindrical barrel 18 by second hinged subassembly 28 as shown in FIG. 2.

When first hinged subassembly 26 is in the closed position shown in FIG. 2, the outer surface of the collar formed by semicircular collar sections 36*a* and 36*b* forms a ring-shaped ridge 54. Said ring-shaped ridge 54 gives the outer surface of the collar a stepped shape which, as will be seen below, is used to form a translation connection between second hinged subassembly 28 and first hinged subassembly 26 while allowing them to rotate relative to one another while in the closed position. Ring-shaped ridge 54 is formed of two sections machined respectively in each of the two semicircular collar sections 36*a* and 36*b.*

Second ring-shaped hinged subassembly 28 will now be described in detail with reference to the figures.

In the version shown, second hinged subassembly 28 is composed of two semicircular ring sections 56*a* and 56*b* that are hinged at one end of each section by means of a hinge pin 58 that is parallel to the axes of each of the two sections. This arrangement allows second hinged subassembly 28 to be either in an open position, as seen in the figures, enabling it to be fitted or removed, or in a closed position (not shown) in which the second hinged subassembly 28 forms a ring.

When in the closed position second hinged subassembly 28 encircles and straddles the rear of plug 10 and the front of first subassembly 26. More precisely, second hinged subassembly 28 encircles both the rear threaded section 20 formed on the cylindrical barrel 18 of plug 10 and the stepped outer surface 54 of the collar formed by the two semicircular collar sections 36*a* and 36*b* of the first hinged subassembly 26.

In order to allow second ring-shaped hinged subassembly 28 to operate in conjunction with threaded rear section 20 and the stepped outer surface 54 respectively, the inner surface of said second subassembly is provided with a threaded forward section 60 and a stepped rear section comprising an annular throat 62 when in the closed position. The threaded forward section 60 and the annular throat 62 are machined respectively in each of the two semicircular collar sections 56*a* and 56*b,* as shown particularly in FIG. 1. More precisely, threaded forward section 60 matches the rear threaded section 20 of the connector and the stepped rear section 62 matches the stepped outer surface 54 of the collar formed by the first hinged subassembly 26 when in the closed position.

The arrangement described above means that when second ring-shaped hinged subassembly 28 is closed and encircles both the rear of plug 10 and the forward section of first hinged subassembly 26, threaded forward section 60 and rear threaded section 20 fit into one another and annular throat 62 fits over ring-shaped ridge 54. It is thus possible to rotate second hinged subassembly 28 around the axis of the connector in order to screw it onto, or unscrew it from said second subassembly without rotating first hinged subassembly 26. The way the annular throat 62 and the ring-shaped ridge 54 fit together means that rotation relative to the two subassemblies is possible. The way these components fit together forms a translation connection between the two subassemblies that is parallel to the axis of the connector. Consequently, when in the closed position the second hinged subassembly 28 is screwed onto the rear threaded section 20, the toothed ring 52 fits onto teeth 22 and first hinged subassembly 26 is fastened to plug 10.

In order to facilitate screwing and unscrewing of second hinged subassembly 28 in the closed position, the outer surface of said subassembly is advantageous knurled or provided with flattened areas.

As can be seen in FIGS. 1 and 2, the sections of the opposite ends of the two semicircular ring sections 56*a* and 56*b* to hinge pin 58 are provided with a removable component to connect them such as a screw 64. This screw 64 lies preferably parallel to the axes of semicircular ring sections 56*a* and 56*b,* i.e. parallel to the axis of the connector when second hinged subassembly 28 is in the closed position and fitted around the rear end of the connector and the forward end of first hinged subassembly 26. This characteristic makes it possible to assemble and dismantle second hinged subassembly 28 even when plug 10 is used in a location with little free space, particularly close to other plugs.

In the version shown particularly in FIG. 2, removable half-flange 32 supports cable clamping means comprising, in this example, a second half-flange 66. Said second half-flange 66 may be fitted to half-flange 32 by removable fastening means comprising, in this example, two screws 68. Screws 68 pass through holes machined in the ends of the second half-flange 66 and screw into threads in the pins 34*a* and 34*b* used to hinge parts 30*a* and 30*b* to half-flange 32.

Each hinged subassembly 26 and 28 is assembled in the factory. For this purpose pins 34*a* and 34*b* and hinge pin 58 advantageously consist of tubular rivets.

In order to install the removable rear connector of the invention, the first hinged subassembly 26 is fitted first. This is done by placing the said first hinged subassembly in the open position as shown in FIG. 1 so that the half-flange 32 is pressing against the bundle of cables 24 and the two semicircular collar sections 36*a* and 36*b* are located behind the cylindrical barrel 18 of plug 10. The first hinged subassembly 26 is then brought into the closed position shown in FIG. 2 so that the collar formed by the two semicircular collar sections 36*a* and 36*b* encircles the bundle of cables 24 immediately behind cylindrical barrel 18.

The second hinged subassembly 28 is then fitted by presenting it in the open position as shown in FIG. 1 and fitting annular throat 62 and threaded forward section 60 of one of the two semicircular ring sections 56*a* and 56*b* respectively on the ring-shaped ridge 54 and in the rear threaded section 20 as shown in FIG. 2.

The second hinged subassembly 28 is then closed by shutting the second semicircular ring section so that it completely encircles the rear threaded section 20 of the connector and the ring-shaped ridge 54 of first hinged subassembly 26. The second hinged subassembly 28 is locked in this closed position by means of screw 64.

Assembly of the connector is completed by screwing the ring formed by the second hinged subassembly 28 onto the rear threaded section 20 of plug 10 until the toothed ring 52 fits onto closely onto teeth 22.

When the removable rear connector is used to retain the bundle of cables 24 as in the example described above, the second half-flange 66 is fastened to the first half-flange by screws 68. The bundle of cables 24 is then clamped between the two half-flanges 32 and 66.

If it is necessary to replace all or part of the removable rear connector for maintenance purposes, it can be removed by performing the above operations in reverse order, again without disconnecting the bundle of cables 24.

As has already been pointed out several times, the invention is not limited to the version described with reference to FIGS. 1 and 2.

For example, the removable rear connector of the invention may serve a different function from that described, such as ensuring leaktightness. The components ensuring leaktightness are supported by the first hinged subassembly in the same way as the components used to support the bundle of cables in the example described.

Moreover, where the removable rear connector is used to clamp the bundle of cables, this function may be fulfilled by means having different forms from those described. For example, cable clamping may be ensured by cable bands, heat-shrunk sleeves, etc. The relative angle between the cable clamping means and the axis of the plug may be different from the coaxial orientation described above. For example, the cables may be held at 45° or 90° to the axis of the plug by making arms 38*a* and 38*b* more elbowed.

Finally, the various means described, particularly those designed to prevent rotation of the first hinged subassembly relative to the connector and to ensure the rotating connection between the two hinged subassemblies may be replaced by any other equivalent means. Similarly the shapes of the two subassemblies, particularly as concerns the number of arc-shaped sections or parts comprising them may be modified without exceeding the scope of the invention. For example, instead of both being hinged on half-flange 32, one of the two arms 38*a,* 38*b* may be rigidly fastened to it; this would reduce costs by eliminating a hinge mechanism.

What is claimed is:

1. Removable rear connector for a plug including a rear threaded section, said connector comprising:

a first hinged subassembly including at least two semicircular collar sections capable of forming a collar having a stepped outer surface;

a second ring-shaped hinged subassembly formed by at least two semicircular ring sections and having an inner surface that includes a threaded forward section and a stepped rear section that respectively match the rear threaded section of the plug and the stepped outer surface of the collar.

2. Connector of claim 1, wherein the collar formed by the first hinged subassembly has a forward surface fitted with anti-rotation means capable of operating in conjunction with complementary means formed on a rear surface of a plug.

3. Connector of claim 2, wherein the anti-rotation means comprise a toothed wheel formed on the forward surface of the collar.

4. Connector of claim 1, wherein the rear stepped section of the inner surface of the second hinged subassembly has an annular throat capable of operating in conjunction with a ring-shaped ridge formed on the surface of the collar.

5. Connector of claim 1, wherein the second hinged subassembly is formed by two semicircular ring sections each having a respective axis, the ring sections being hinged at one end of each section and capable of being connected at their other ends by a removable component that is parallel to the axis of each of the two sections.

6. Connector of claim 1, wherein the first hinged subassembly comprises two semicircular collar sections that are fastened rigidly to first ends of two arms and a half-flange to which the other end of at least one of said two arms is hinged.

7. Connector of claim 6, wherein the two arms are hinged on the half-flange.

8. Connector of claim 6, where cable-clamping means are fitted to the half-flange by removable fastening means.

9. Connector of claim 8, wherein the cable clamping means comprise a second half-flange.

10. Connector of claim 1, wherein the semicircular collar sections of the first hinged subassembly have ends whose matching shapes make them capable of fitting one another.

* * * * *